US008820082B2

(12) United States Patent
Yoshimura

(10) Patent No.: US 8,820,082 B2
(45) Date of Patent: Sep. 2, 2014

(54) SCREW EXPANDER SYSTEM

(75) Inventor: Shoji Yoshimura, Takasago (JP)

(73) Assignee: Kobe Steel, Ltd., Kobe-shi (JP)

( * ) Notice: Subject to any disclaimer, the term of this patent is extended or adjusted under 35 U.S.C. 154(b) by 58 days.

(21) Appl. No.: 13/512,495

(22) PCT Filed: Dec. 13, 2010

(86) PCT No.: PCT/JP2010/072389

§ 371 (c)(1),
(2), (4) Date: May 29, 2012

(87) PCT Pub. No.: WO2011/074539

PCT Pub. Date: Jun. 23, 2011

(65) Prior Publication Data

US 2012/0237382 A1 Sep. 20, 2012

(30) Foreign Application Priority Data

Dec. 14, 2009 (JP) ..... 2009-283182

(51) Int. Cl.
*F01K 25/00* (2006.01)

(52) U.S. Cl.
USPC ..... 60/671; 418/83; 418/85; 418/88; 418/97; 418/98; 418/201.1; 418/270

(58) Field of Classification Search
USPC ..... 60/657, 649, 651, 671, 673, 653; 418/83, 85, 86, 88, 97, 98–100, 201.1, 418/270, DIG. 1
See application file for complete search history.

(56) References Cited

U.S. PATENT DOCUMENTS

| | | | | |
|---|---|---|---|---|
| 4,008,573 | A * | 2/1977 | Petrillo | 60/651 |
| 4,191,021 | A * | 3/1980 | Nakamura et al. | 60/657 |
| 5,664,419 | A * | 9/1997 | Kaplan | 60/641.2 |
| 6,981,377 | B2 * | 1/2006 | Vaynberg et al. | 60/641.8 |
| 2009/0151356 | A1 * | 6/2009 | Ast et al. | 60/660 |
| 2009/0188253 | A1 | 7/2009 | Smith et al. | |

FOREIGN PATENT DOCUMENTS

| | | | |
|---|---|---|---|
| CA | 2 610 762 | A1 | 12/2006 |
| CN | 101194084 | | 6/2008 |
| CN | 101194084 | A | 6/2008 |
| EP | 1 896 698 | A | 3/2008 |
| GB | 2427002 | B | 12/2010 |

(Continued)

OTHER PUBLICATIONS

International Search Report Issued Mar. 1, 2011 in PCT/JP10/72389 Filed Dec. 13, 2010.

(Continued)

*Primary Examiner* — Kenneth Bomberg
*Assistant Examiner* — Wesley Harris
(74) *Attorney, Agent, or Firm* — Oblon, Spivak, McClelland, Maier & Neustadt, L.L.P.

(57) ABSTRACT

A screw expander system has a condenser positioned for receiving a mixture of oil and operating medium from a screw expander. A pump pressure-feeds the mixture from the condenser to an evaporator where the operating medium is evaporated. An oil separating tank separates the mixture from the evaporator into the gaseous operating medium and the oil, and the operating medium is returned to the screw expander via a throttle mechanism. The oil can thereby be supplied to the screw expander without providing a separate oil pump, as a result of which the screw expander system is compact.

6 Claims, 6 Drawing Sheets

(56) References Cited

FOREIGN PATENT DOCUMENTS

| | | | |
|---|---|---|---|
| JP | 58 32908 | | 2/1983 |
| JP | 59 41609 | | 3/1984 |
| JP | 60 60209 | | 4/1985 |
| JP | 11 101106 | | 4/1999 |
| JP | 2004 332626 | | 11/2004 |
| JP | 2007 315190 | | 12/2007 |
| JP | 2008 542629 | | 11/2008 |
| KR | 10-2008-0025400 | A | 3/2008 |
| WO | WO 2006/131759 | A2 | 12/2006 |
| WO | WO 2006/131759 | A3 | 12/2006 |

OTHER PUBLICATIONS

The Extended European Search Report issued May 3, 2013, in Application No. Patent No. 10837565.0-1610 / 2514932 PCT/JP2010072389.

Japanese Office Action issued May 8, 2012 in Patent Application No. 2009-283182 with English Translation.

Office Action issued on Jun. 25, 2013 in the corresponding Korean Application No. 10-2012-7015277 (with English and Japanese translation).

International Search Report issued Mar. 1, 2011 in PCT/JP2010/072389.

* cited by examiner

SCREW EXPANDER SYSTEM

The present application is a national stage of PCT/JP10/072,389 filed on Dec. 13, 2010, and claims priority under 35 U.S.C. §119 from Japanese patent application 2009-283182 filed on Dec. 14, 2009, and which is hereby incorporated by reference in its entirety.

TECHNICAL FIELD

The present invention relates to a screw expander system.

BACKGROUND ART

As shown in Patent Document 1, there is a known screw expander system in which a generator is driven by an oil-feed type screw expander (screw turbine). As shown in FIG. 6, this screw expander system 100 includes a generator main body 105 in which a rotor shaft 103 of a screw rotor 102 of a screw expander 101 is coupled to a generator 104, an oil separating tank 106, a condenser 107, an operating medium pump 108, an evaporator 109, an oil service tank 110, an oil tank 111, and an oil pump 112.

The screw expander 101 expands an operating medium sent through an operating medium inlet 113 by the screw rotor 102, and discharges from an operating medium outlet 114. In the screw expander 101, oil is supplied from an oil inlet 115 to a bearing 116 supporting the rotor shaft 103, the oil is discharged from the operating medium outlet 114 communicating with an oil outlet 117, the oil is supplied from an oil inlet 120 communicating with the operating medium inlet 113 to an outer circumferential surface of the screw rotor 102, and the oil is discharged from the operating medium outlet 114. The operating medium and the oil discharged from the operating medium outlet 114 become a mixture, which is sent to the oil separating tank 106. In the oil separating tank 106, the mixture is separated into the oil and the operating medium. The operating medium separated in the oil separating tank 106 is liquefied in the condenser 107, and sent to the evaporator 109 by the operating medium pump 108. The operating medium is evaporated by the evaporator 109, and sent to the operating medium inlet 113 of the screw expander 101. The oil is sent from an oil discharge port 118 of the oil separating tank 106 to the oil tank 111. The oil is sent by the oil pump 112 from the oil tank 111 to the bearing 116 and the outer circumferential surface of the screw rotor 102 through the oil inlets 115, 120 of the screw expander 101. In the screw expander system 100, the oil service tank 110 is disposed in an oil supply line 119 connected so as to be branched from the upstream side of an inlet of the oil separating tank 106 and merged with the downstream side of the oil discharge port 118, and the oil is supplemented from the oil service tank 110 to the oil tank 111 in accordance with a pressure difference between the upstream side of the inlet of the oil separating tank 106 and the downstream side of the oil discharge port 118.

However, since the oil outlet 117 of the screw expander 101 has a low pressure in comparison to the oil inlets 115, 120, the oil pump 112 is required for supplying the oil from the oil tank 111 on the downstream of the oil outlet 117 to the screw expander 101. Size of the oil separating tank 106 depends on flow speed of a gas or a volume flow rate (for example, substantially proportional to the flow speed of the gas or the volume flow rate). As described above, the operating medium outlet 114 of the screw expander 101 has a low pressure in comparison to the operating medium inlet 113, and the volume flow rate of the gas flowing into the oil separating tank 106 is increased. Thus, there is a need for increasing the size of the oil separating tank 106, and there is a problem that size of the screw expander system 100 is increased.

CITATION LIST

Patent Document

Patent Document 1: Japanese Unexamined Patent Application Publication No. H11-101106

SUMMARY OF THE INVENTION

Problems to be Solved by the Invention

An object of the present invention is to provide a screw expander system capable of supplying oil to a screw expander without providing an oil supply means such as an oil pump, so as to decrease size of the device.

Means for Solving the Problems

As a means for achieving the above object, a screw expander system of the present invention includes a screw expander including an expansion space formed by screw rotors meshed with each other, the expansion space for expanding an operating medium, an operating medium inlet and an operating medium outlet communicating with the expansion space, a bearing for supporting a rotor shaft of the screw rotor, an oil inlet for supplying oil to at least one of the expansion space and the bearing, and an oil outlet for discharging the oil from at least one of the expansion space and the bearing, a main body outlet side line connected to the operating medium outlet and the oil outlet, the main body outlet side line for feeding the operating medium from the operating medium outlet and the oil from the oil outlet, a condenser disposed in the main body outlet side line, a pump connected to the main body outlet side line, the pump for pressure-feeding a mixture of the operating medium and the oil fed by the main body outlet side line, and an evaporator for evaporating the operating medium in the mixture pressure-fed by the pump, wherein in the screw expander system for circulating and supplying the operating medium from the evaporator to the operating medium inlet, and circulating and supplying the oil from the evaporator to the oil inlet, an oil separating tank for separating the operating medium and the oil is disposed between the evaporator and the screw expander, the oil separating tank having an operating medium containing section for containing the separated operating medium, and an oil containing section for containing the separated oil, and the oil containing section of the oil separating tank is connected to the oil inlet of the screw expander.

According to this configuration, the operating medium is supplied to the operating medium inlet, expanded in the expansion space of the screw rotors, and then discharged from the operating medium outlet while having a lower pressure than the operating medium at the operating medium inlet. The operating medium discharged from the operating medium outlet and fed by the main body outlet side line is condensed in the condenser, and then pressure-fed to the evaporator by the pump. The operating medium is evaporated in the evaporator. Since a pressure inside the oil separating tank is boosted by the pump, the pressure becomes higher than the operating medium outlet. The oil of the oil inlet is supplied into the screw rotors, and flows to the oil outlet. The oil of the oil outlet becomes the mixture with the operating medium of the operating medium outlet and is fed by the main body outlet side line, and sent to the pump through the condenser. The mixture is pressure-fed by the pump to the oil separating tank through the evaporator. In the oil separating tank, the mixture is separated into the operating medium and the oil, the operating medium is contained in the operating medium containing section, and the oil is contained in the oil containing section. The oil of the oil containing section of the oil separating tank flows to the oil inlet by a pressure difference.

Preferably, the oil inlet includes a first oil inlet communicating with the bearing, and a second oil inlet communicating with the expansion space, and a pressure adjusting means for adjusting a pressure on the upstream side and a pressure on the downstream side is disposed between the operating medium containing section of the oil separating tank and the operating medium inlet of the screw expander. According to this configuration, inside the oil separating tank, since the mixture from the operating medium outlet is pressure-fed by the pump, the pressure is high in comparison to the operating medium outlet. The oil containing section of the oil separating tank is connected to the first oil inlet and the second oil inlet of the screw expander. The first oil inlet communicates with the oil outlet via the bearing. The oil outlet communicates with the operating medium outlet. Since there is a pressure difference between the oil containing section of the oil separating tank and the oil outlet, the oil flows from the oil containing section of the oil separating tank to the side of the oil outlet. Therefore, without providing an oil supply means such as an oil pump, the oil can be supplied from the oil separating tank to the bearing supporting the rotor shaft of the screw rotor. The pressure adjusting means adjusts the pressure on the upstream side and the pressure on the downstream side in such a manner that the pressure on the upstream side of the pressure adjusting means has a larger value than the pressure on the downstream side. Since the upstream side of the pressure adjusting means communicates with the oil tank, the pressure of the oil separating tank has the substantially same value as the pressure on the upstream side of the pressure adjusting means. Since the downstream side of the pressure adjusting means communicates with the first oil inlet via the operating medium inlet, the pressure of the first oil inlet has the substantially same value as the pressure on the downstream side of the pressure adjusting means. Since there is a pressure difference between the oil containing section of the oil separating tank and the first oil inlet, the oil flows from the oil containing section of the oil separating tank to the side of the first oil inlet. Therefore, without providing an oil supply means such as an oil pump, the oil from the oil separating tank can be supplied from the operating medium inlet communicating with the first oil inlet to the expansion space.

Preferably, the oil inlet communicates with the bearing. According to this configuration, inside the oil separating tank, since the mixture from the operating medium outlet is pressure-fed by the pump, the pressure is high in comparison to the operating medium outlet. The oil containing section of the oil separating tank is connected to the oil inlet of the screw expander. The oil inlet communicates with the oil outlet via the bearing. The oil outlet communicates with the operating medium outlet. Since there is a pressure difference between the oil containing section of the oil separating tank and the oil outlet, the oil flows from the oil containing section of the oil separating tank to the side of the oil outlet. Therefore, without providing an oil supply means such as an oil pump, the oil can be supplied from the oil separating tank to the bearing supporting the rotor shaft of the screw rotor.

Preferably, the oil inlet communicates with the expansion space, and a pressure adjusting means for adjusting a pressure on the upstream side and a pressure on the downstream side is disposed between the operating medium containing section of the oil separating tank and the operating medium inlet of the screw expander. According to this configuration, the pressure adjusting means adjusts the pressure on the upstream side and the pressure on the downstream side in such a manner that the pressure on the upstream side of the pressure adjusting means has a larger value than the pressure on the downstream side. Since the upstream side of the pressure adjusting means communicates with the oil tank, the pressure of the oil separating tank has the substantially same value as the pressure on the upstream side of the pressure adjusting means. Since the downstream side of the pressure adjusting means communicates with the oil inlet via the operating medium inlet, the pressure of the oil inlet has the substantially same value as the pressure on the downstream side of the pressure adjusting means. Since there is a pressure difference between the oil containing section of the oil separating tank and the oil inlet, the oil flows from the oil containing section of the oil separating tank to the side of the oil inlet. Therefore, without providing an oil supply means such as an oil pump, the oil can be supplied from the oil separating tank to the operating medium inlet communicating with the oil inlet and the expansion space.

Preferably, a heat exchanger for exchanging heat between the mixture fed from the condenser to the side of the evaporator, and the oil supplied from the oil separating tank to the bearing through the oil inlet is provided. According to this configuration, heat is exchanged between the mixture fed from the condenser to the side of the evaporator, and the oil fed from the oil separating tank to the side of the oil inlet by the heat exchanger. That is, the oil heated in the evaporator and fed to the side of the oil inlet through the oil separating tank has a relatively high temperature to the mixture fed from the condenser to the side of the evaporator. Thus, the oil is cooled by the mixture fed from the condenser to the side of the evaporator. Therefore, with a simple configuration utilizing the mixture of the operating medium and the oil inside the device, the oil to be supplied to the oil inlet can be cooled. Thereby, viscosity of the oil to be supplied to the bearing can be properly maintained, and eventually, sufficient lubrication of the bearing can be maintained.

Preferably, a branch section is provided between the pump and the evaporator, and the branch section is connected to the oil inlet communicating with the expansion space of the screw rotors. According to this configuration, the mixture pressure-fed by the pump is pressure-fed to the evaporator, and also pressure-fed to the oil inlet communicating with the expansion space of the screw rotors through the branch section. Thereby, without providing an oil supply means such as an oil pump, the oil forming the mixture can be supplied to the expansion space of the screw expander through the oil inlet.

Preferably, a preheater is provided on the upstream side of the evaporator, the preheater for heating the mixture pressure-fed by the pump, a gas-liquid separator for separating a mixture containing a gas and a liquid from a production well into a gas and a liquid is provided, the gas-liquid separator having a gas containing section for containing the gas, and a liquid containing section positioned on the lower side of the gas containing section, for containing the liquid, the gas is sent from the gas containing section of the gas-liquid separator to the evaporator, the mixture is evaporated by exchanging heat with the gas by the evaporator, the gas, the liquid, or the gas-liquid mixture from the evaporator, and the liquid from the liquid containing section of the gas-liquid separator are merged and fed to the preheater, heat is exchanged between the liquid or the gas-liquid mixture merged in the preheater, and the mixture pressure-fed by the pump, and then the gas-liquid mixture is fed out from the preheater to a reduction well. According to this configuration, after the gas and the liquid from the production well are separated in the gas-liquid separator, the liquid having a relatively low temperature is fed to the preheater, and the mixture sent to the evaporator is heated. The gas having a relatively high temperature is sent to the evaporator, and the mixture pressure-fed by the pump and heated in the preheater is evaporated in the evaporator. Since the mixture sent to the evaporator is preliminarily heated in the preheater and the temperature is increased, the mixture can be more reliably evaporated in the evaporator.

Preferably, a returning flow passage which is connected to the main body outlet side line and to a pump outlet side line connected to an outlet of the pump, and in which an open/close valve is disposed is provided. According to this configuration, by opening the open/close valve of the returning flow passage, the mixture of the pump outlet side line pressure-fed by the pump is returned to the main body outlet side line. In such a way, in a case where a supply amount of the operating medium supplied from the pump outlet side line is excessive, the supply amount can be corrected.

Effects of the Invention

According to the present invention, by providing the oil separating tank on the downstream of the pump, the pressure of the mixture from the operating medium outlet can be boosted by the pump and fed to the oil separating tank. By the pressure difference between the inside of the oil separating tank and the oil inlet of the screw expander, the oil can be supplied to the oil inlet of the screw expander without providing an oil supply means such as an oil pump. By providing the oil separating tank on the downstream of the pump, there is no need for increasing size of the tank in comparison to a case where the tank is provided in the main body outlet side line, so that size of the device can be decreased. In a case where the oil is supplied to not only the bearing but also both the bearing and the expansion space of the screw rotors, by supplying the oil serving as a sealing material to the expansion space of the screw rotors, leakage of the operating medium is not easily generated inside the expansion space, and an unnecessary decrease in the pressure of the operating medium due to the leakage can be suppressed. Thus, a loss of mechanical power can be reduced.

MODES FOR CARRYING OUT THE INVENTION

Hereinafter, embodiments of the present invention will be described with reference to the drawings.

Figure 1:
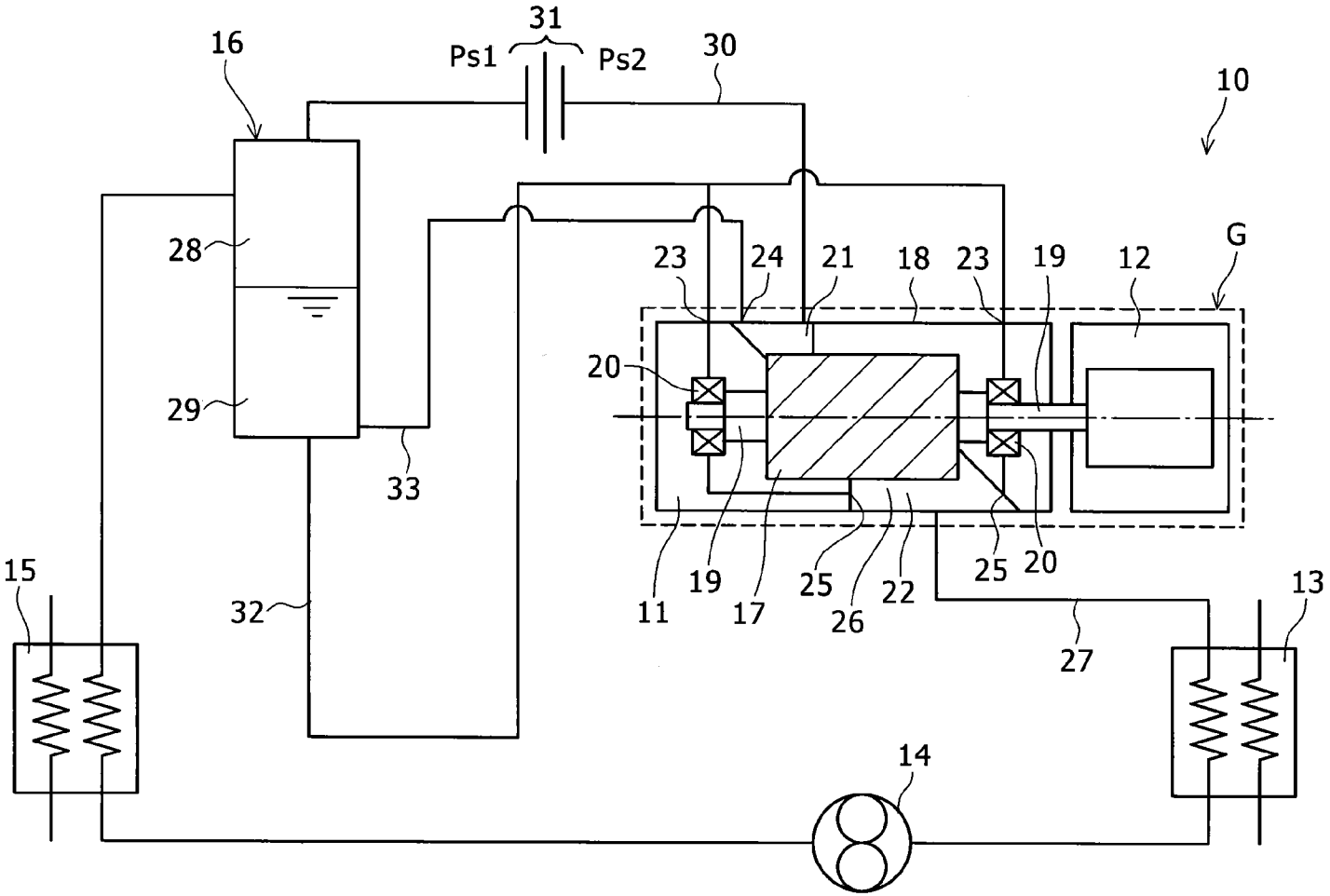
FIG. 1 A schematic view of a screw expander system of a first embodiment of the present invention.

FIG. 1 shows a screw expander system 10 of a first embodiment of the present invention. This screw expander system 10 includes a screw expander 11, a condenser 13, a pump 14, an evaporator 15, and an oil separating tank 16.

The screw expander 11 includes a pair of male and female screw rotors 17 meshed with each other. FIG. 1 only shows the screw rotor 17 connected to a generator 12 among the pair of male and female screw rotors 17 rotatably contained inside a casing 18. Rotor shafts 19 extending on both sides in the rotation shaft direction are provided in the screw rotor 17. The rotor shaft 19 on the side of the generator 12 penetrates a surface of the casing 18 on the side of the generator 12 and protrudes to the outside. The rotor shafts 19, 19 on both the sides of the screw rotor 17 are respectively supported by bearings 20, 20. In the screw expander 11, an expansion space for expanding an operating medium is formed by the pair of male and female screw rotors 17 and the casing 18 containing the screw rotors 17. The operating medium in the present embodiment is HCFC (hydrochlorofluorocarbon). Oil such as turbine oil is mixed into the operating medium. An operating medium inlet 21 and an operating medium outlet 22 communicating with this expansion space are provided in the screw expander 11. It should be noted that in the expansion space, a space not directly communicating with the operating medium inlet 21 and the operating medium outlet 22 is also formed in a process of rotating the screw rotors 17 so as to expand the operating medium. However, for simplicity, it is described here that the operating medium inlet 21 and the operating medium outlet 22 communicate with the expansion space. In the screw expander 11, first oil inlets 23, 23 communicating with the bearings 20, for supplying oil to the bearings 20 are respectively provided. In the screw expander 11, a second oil inlet 24 opened in the operating medium inlet 21 for supplying the oil to outer circumferential surfaces of the rotors, eventually, to the expansion space, is provided. Since a pressure of the operating medium outlet 22 is lower than a pressure of the operating medium inlet 21 in the screw expander 11, the second oil inlet 24 is desirably provided in the operating medium inlet 21 from a viewpoint of avoiding performance deterioration. Since the second oil inlet 24 is opened in the operating medium inlet 21 as described above, it can be said that the second oil inlet communicates with the expansion space. In the screw expander 11, first oil outlets 25, 25 for discharging the oil from the bearings 20, 20 are respectively provided. The first oil outlets 25, 25 are provided so as to be opened in the operating medium outlet 22. A second oil outlet 26 for discharging the oil from the outer circumferential surfaces of the rotors of the screw expander 11, eventually from the expansion space, is the same as the operating medium outlet 22.

The generator 12 is a device for utilizing electromagnetic induction so as to obtain electric energy by interworking between a rotor (not shown) and a stator (not shown). A rotor shaft of the generator 12 is connected to the rotor shaft 19 penetrating the casing 18 of the screw expander 11 and protruding to the outside via speed-up/down gears (gear mechanism) (not shown) or a coupling. By rotating and driving the rotor shaft 19 of the screw expander 11, the generator 12 converts mechanical energy into electric energy. The screw expander 11 and the generator 12 form a generation unit G.

A main body outlet side line 27 is connected to the operating medium outlet 22 of the screw expander 11. The condenser 13 for liquefying a gas is disposed in the main body outlet side line 27.

An outlet of the condenser 13 is connected to an inlet of the pump 14. The pump 14 pressure-feeds a mixture of the operating medium and the oil fed by the main body outlet side line 27.

An outlet of the pump 14 is connected to the evaporator 15 for evaporating and gasifying the operating medium in the mixture pressure-fed by the pump 14.

The oil separating tank 16 for separating the mixture of the operating medium and the oil into the operating medium and the oil is provided on the downstream of the evaporator 15. An outlet of the evaporator 15 is connected to the oil separating tank 16 at an upper part of the oil separating tank 16. The oil separating tank 16 includes an operating medium containing section 28 for containing the separated operating medium, and an oil containing section 29 for containing the separated oil. In the present embodiment, the operating medium containing section 28 is the upper part inside the oil separating tank 16, and the oil containing section 29 is a lower part relative to the operating medium containing section 28. As the oil separating tank 16, other type tanks such as a tank of a type of forming a swirl flow and centrifugally separating the oil, and a tank of catching the oil by elements may be adopted.

The operating medium containing section 28 of the oil separating tank 16 is connected to the operating medium inlet 21 of the screw expander 11 by an operating medium supply flow passage 30. A throttle mechanism (pressure adjusting means) 31 for adjusting a pressure on the upstream side (the side of the oil separating tank 16) and a pressure on the downstream side (the side of the operating medium inlet 21) is disposed in the operating medium supply flow passage 30. The throttle mechanism 31 is adjusted to obtain Ps1>Ps2 when the pressure on the upstream side of the throttle mechanism 31 is Ps1, and the pressure on the downstream side is Ps2.

The oil containing section 29 of the oil separating tank 16 is connected to the first oil inlets 23, 23 by a bearing oil supply flow passage 32. A valve such as a check valve may be disposed in the bearing oil supply flow passage 32. The oil containing section 29 of the oil separating tank 16 is connected to the second oil inlet 24 by an expander main body oil supply flow passage 33. A valve such as a check valve may be disposed in the expander main body oil supply flow passage 33.

Operations of the screw expander system 10 with the above configuration will be described.

The screw expander 11 expands the operating medium sent through the operating medium inlet 21 in the expansion space of the screw rotors 17, and discharges the operating medium from the operating medium outlet 22. The screw expander 11 supplies the oil from the first oil inlets 23 to the bearings 20 supporting the rotor shafts 19, discharges the oil from the operating medium outlet 22 communicating with the first oil outlets 25, supplies the oil to the outer circumferential surfaces of the screw rotors 17, eventually to the expansion space, from the second oil inlet 24 communicating with the operating medium inlet 21, and discharges the oil from the operating medium outlet 22 communicating with the second oil outlet 26. In the present embodiment, a pressure around the bearings 20 is substantially an atmospheric pressure. The operating medium and the oil discharged from the operating medium outlet 22 become a mixture of the operating medium in a gas state and the oil in a mist state (granular state, liquid), and are fed to the condenser 13 by the main body outlet side line 27. In the present embodiment, a pressure of the main body outlet side line 27 is 0.16 MPa. In the condenser 13, the gaseous operating medium of the mixture is liquefied. The mixture in which both the operating medium and the oil are liquid is sent from the condenser 13 to the pump 14. The pump 14 boosts a pressure of the mixture and pressure-feeds the mixture to the evaporator 15. In the present embodiment, a pressure between the pump 14 and the evaporator 15 is 0.8 MPa. In the evaporator 15, heat is exchanged between the mixture pressure-fed by the pump 14 and a high-temperature fluid (such as vapor), so that a temperature of the mixture is increased. As a result, among the mixture, the operating medium is brought into a gas state, while the oil remains in a mist state (granular state, liquid). The mixture of the operating medium and the oil from the evaporator 15 is sent to the oil separating tank 16. In the present embodiment, a pressure between the evaporator 15 and the oil separating tank 16 is obtained by subtracting a pressure loss a generated in the evaporator 15 from 0.8 MPa. In the oil separating tank 16, the mixture of the operating medium in a gas state and the oil in a liquid state is separated into the oil and the operating medium by gravity force. The operating medium is contained in the operating medium containing section 28, and the oil is contained in the oil containing section 29.

When the throttle mechanism 31 of the operating medium supply flow passage 30 is adjusted to obtain Ps1 (pressure on the upstream side)>Ps2 (pressure on the downstream side), and a fixed time elapses, a pressure inside the oil separating tank 16 connected to the upstream side of the throttle mechanism 31 of the operating medium supply flow passage 30 becomes the substantially same value as Ps1. A pressure of the operating medium inlet 21 of the screw expander 11 connected to the downstream side of the throttle mechanism 31 of the operating medium supply flow passage 30 becomes the substantially same value as Ps2. That is, the pressure inside the oil separating tank 16 is higher than a pressure of the second oil inlet 24 communicating with the operating medium inlet 21 of the screw expander 11. Therefore, the operating medium separated in the oil separating tank 16 is sent from the operating medium containing section 28 to the operating medium supply flow passage 30, and the oil of the oil containing section 29 of the oil separating tank 16 is supplied to the second oil inlet 24.

Meanwhile, a pressure of the first oil inlets 23 communicating with the operating medium outlet 22 via the first oil outlets 25 is also relatively low to the pressure of the oil separating tank 16. Therefore, part of the oil from the oil containing section 29 of the oil separating tank 16 can be supplied to the first oil inlets 23.

By providing the oil separating tank 16 on the downstream of the pump 14, the pressure of the mixture from the operating medium outlet 22 can be boosted by the pump 14 and the mixture can be fed to the oil separating tank 16. By a pressure difference between the inside of the oil separating tank 16 and the oil inlets 23, 24 of the screw expander 11, the oil can be supplied to the oil inlets 23, 24 of the screw expander 11 without providing an oil supply means such as an oil pump. By providing the oil separating tank 16 on the downstream of the pump 14, there is no need for increasing size of the tank in comparison to a case where the tank is provided in the main body outlet side line 27, so that size of the device can be decreased. In a case where the oil is supplied to both the bearings 20 and the expansion space of the screw rotors 17, a decrease in the pressure of the operating medium for driving the screw expander 11, eventually the generator 12, can be suppressed. Thus, a loss of mechanical power can be reduced.

It should be noted that, in general, a volume flow rate of the operating medium mixing with the oil to be supplied to the oil separating tank 16 is about one N-th (N is an integral not less than one and not more than ten) (such as about one fifth) of a volume flow rate of the operating medium on the side of the operating medium outlet 22 of the screw expander 11. As described above, in order to obtain a desired effect of oil separation, there is a need for making the size of the oil separating tank 16 substantially proportional to flow speed (or a volume flow rate) of the gas. Consequently, when the oil separating tank 16 is provided on the side of the operating medium inlet 21 of the screw expander 11 as in the present invention, the size can be suppressed to about one N-th in comparison to a case where the tank is provided in the operating medium outlet 22.

Figure 2:
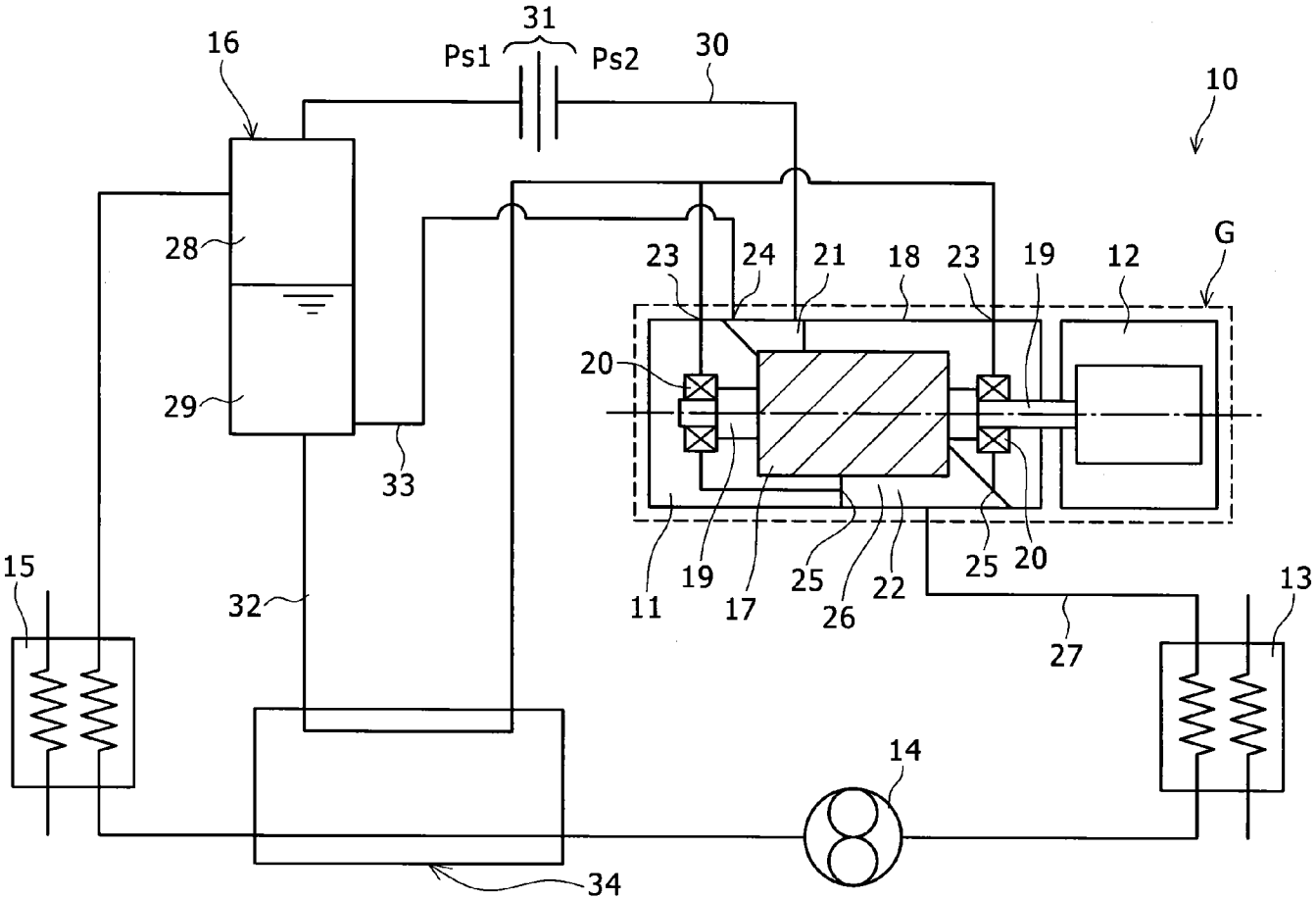
FIG. 2 A schematic view of the screw expander system of a second embodiment of the present invention.

FIG. 2 shows the screw expander system 10 of a second embodiment of the present invention. In the present embodiment, the same constituent elements as the first embodiment will be given the same reference numerals and description thereof will be omitted.

In addition to the configuration of the first embodiment, the screw expander system 10 includes a heat exchanger 34 for exchanging heat between the mixture of the operating medium and the oil fed from the condenser 13 to the side of the evaporator 15, and the oil sent by the bearing oil supply flow passage 32 from the oil separating tank 16 to the side of the first oil inlets 23.

During operation of the screw expander system 10, the oil heated in the evaporator 15 and fed to the side of the first oil inlets 23 through the oil separating tank 16 has a relatively high temperature to the mixture fed from the condenser 13 to the side of the evaporator 15. Therefore, heat is exchanged between the mixture fed from the condenser 13 to the side of the evaporator 15 and the oil fed by the bearing oil supply flow passage 32 from the oil separating tank 16 to the side of the first oil inlets 23 by the heat exchanger 34. As a result, the oil fed by the bearing oil supply flow passage 32 from the oil separating tank 16 to the side of the first oil inlets 23 is cooled by the mixture fed from the condenser 13 to the side of the evaporator 15. Therefore, with a simple configuration utilizing the mixture of the operating medium and the oil inside the screw expander system 10, the oil to be supplied to the first oil inlets 23 can be cooled. Thereby, viscosity of the oil to be supplied to the bearings 20 can be properly maintained, and eventually, sufficient lubrication of the bearings 20 can be maintained.

Figure 3:
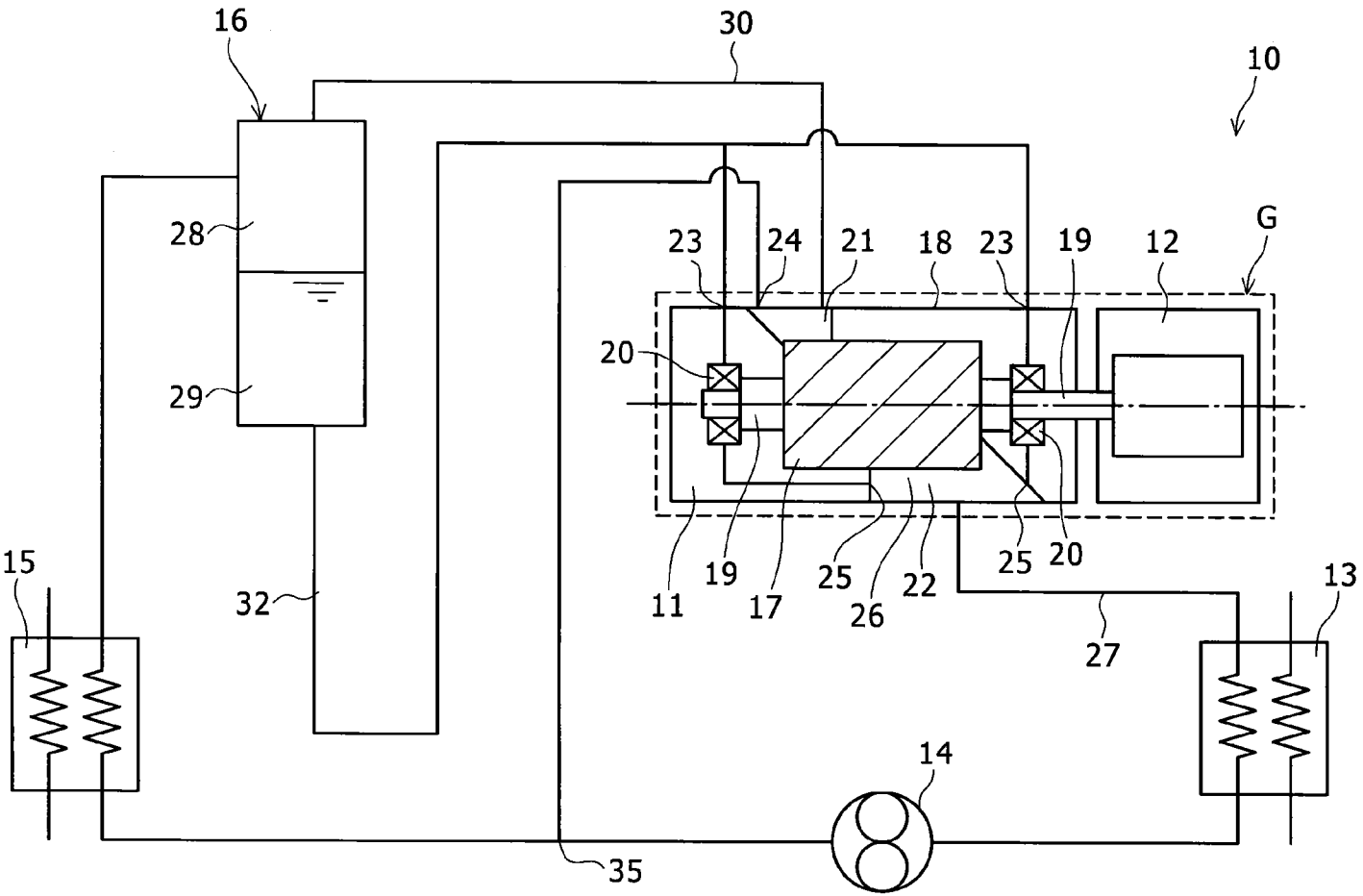
FIG. 3 A schematic view of the screw expander system of a third embodiment of the present invention.

FIG. 3 shows the screw expander system 10 of a third embodiment of the present invention. In the present embodiment, the same constituent elements as the first embodiment will be given the same reference numerals and description thereof will be omitted.

Relative to the configuration of the first embodiment, the screw expander system 10 does not include the throttle mechanism 31 and the expander main body oil supply flow passage 33. A branch section 35 is provided between the pump 14 and the evaporator 15. The branch section 35 is connected to the second oil inlet 24 opened in the operating medium inlet 21.

In the present embodiment, a pressure of the branch section 35 between the pump 14 and the evaporator 15 is 0.8 MPa. The pressure between the evaporator 15 and the oil separating tank 16 is obtained by subtracting the pressure loss a generated in the evaporator 15 from 0.8 MPa. The pressure of the oil separating tank 16 is a value $(0.8-\alpha-\beta)$ which is further slightly lower than the above pressure value. Since the oil separating tank 16 communicates with the operating medium inlet 21 of the screw expander 11, the pressure of the operating medium inlet 21 is $(0.8-\alpha-\beta)$ MPa. Therefore, a pressure difference is generated between the branch section 35 and the operating medium inlet 21. As a result, the mixture pressure-fed by the pump 14 is pressure-fed to the evaporator 15, and pressure-fed to the second oil inlet 24 opened in the operating medium inlet 21 of the screw expander 11 through the branch section 35. Thereby, without providing an oil supply means such as an oil pump, the oil forming the mixture can be supplied to the expansion space of the screw expander 11 through the operating medium inlet 21. By the supplied oil, the screw rotors 17 are lubricated, and sealing is formed in the expansion space of the screw expander 11. Thereby, a performance of the screw expander 11 can be maintained. In the present embodiment, since there is no need for providing the throttle mechanism 31, the pressure of the operating medium for driving the screw expander 11, eventually the generator 12, is not lowered. Thus, the loss of the mechanical power can be reduced. It should be noted that although the operating medium in a liquid state is also supplied to the expansion space of the screw expander 11 through the operating medium inlet 21, there is no problem.

Figure 4:
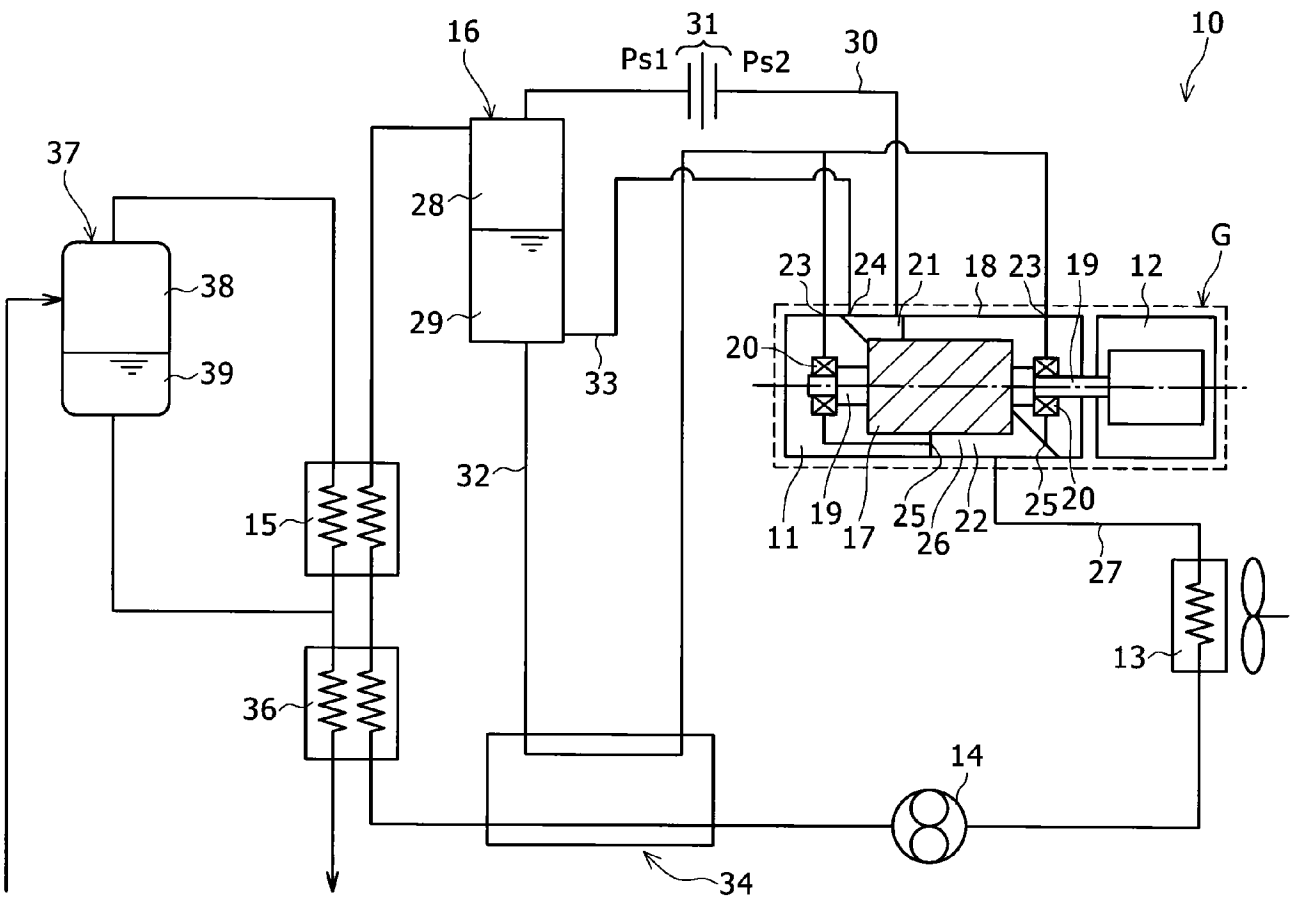
FIG. 4 A schematic view of the screw expander system of a fourth embodiment of the present invention.

FIG. 4 shows the screw expander system 10 of a fourth embodiment of the present invention. The present embodiment is obtained by applying the second embodiment to a facility of geothermal binary power generation. In the present embodiment, the same constituent elements as the first embodiment will be given the same reference numerals and description thereof will be omitted.

In addition to the configuration of the first embodiment, the screw expander system 10 includes a preheater 36 for heating the mixture pressure-fed by the pump 14 on the upstream side of the evaporator 15.

The screw expander system 10 also includes a gas-liquid separator 37 for separating a mixture containing a gas and a liquid from a production well guided from the underground into a gas and a liquid. The gas-liquid separator 37 is provided with a gas containing section 38 for containing the gas, and a liquid containing section 39 positioned on the lower side of the gas containing section 38, for containing the liquid. The gas containing section 38 of the gas-liquid separator 37 is connected to the evaporator 15 and the preheater 36 in order, and guided to the underground via a reduction well. The liquid containing section 39 of the gas-liquid separator 37 is connected between the preheater 36 and the evaporator 15 so as to be merged with a flow passage from the gas containing section 38.

In the present embodiment, the heat exchanger 34 is provided as well as the second embodiment. The condenser 13 is an air-cooled type condenser.

The mixture containing the gas (vapor) and the liquid (hot water) jetted from the production well is separated into the gas and the liquid in the gas-liquid separator 37. The gas is contained in the gas containing section 38, and the liquid is contained in the liquid containing section 39. The gas from the gas containing section 38 of the gas-liquid separator 37 is sent to the evaporator 15, and the mixture pressure-fed by the pump 14 is evaporated by exchanging heat with the gas by the evaporator 15. The gas, the liquid, or the gas-liquid mixture from the evaporator 15, and the liquid from the liquid containing section 39 of the gas-liquid separator 37 are merged and fed to the preheater 36, heat is exchanged between the liquid or the gas-liquid mixture merged in the preheater 36, and the mixture pressure-fed by the pump 14, and then the gas-liquid mixture is fed out from the preheater 36 to the reduction well guided to the underground.

In such a way, by feeding the liquid having a relatively low temperature to the preheater 36, preliminarily heating the liquid by the preheater 36, and sending the gas having a relatively high temperature to the evaporator 15, the mixture sent to the evaporator 15 can be more reliably evaporated.

Figure 5:
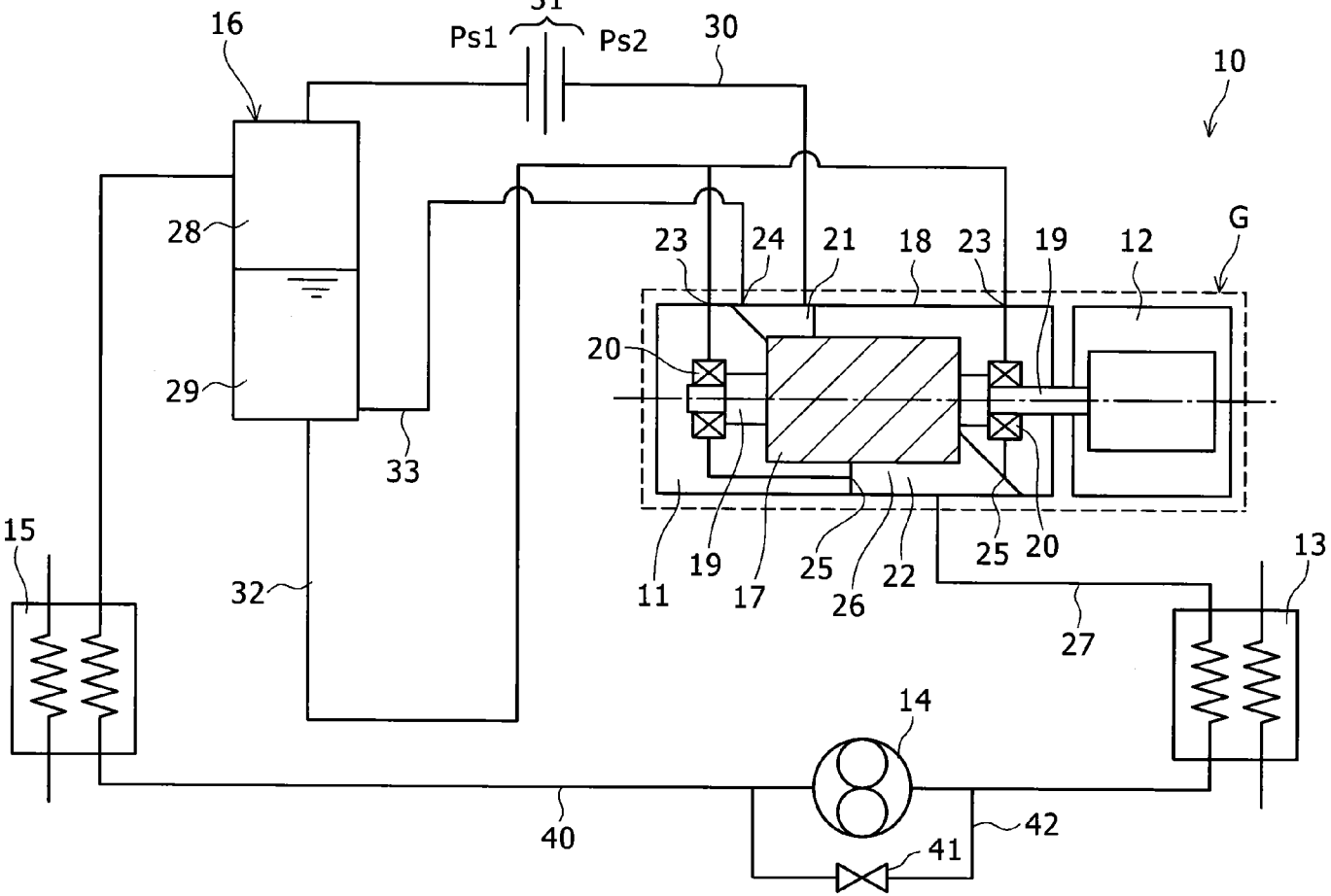
FIG. 5 A schematic view of the screw expander system of a fifth embodiment of the present invention.
Figure 6:
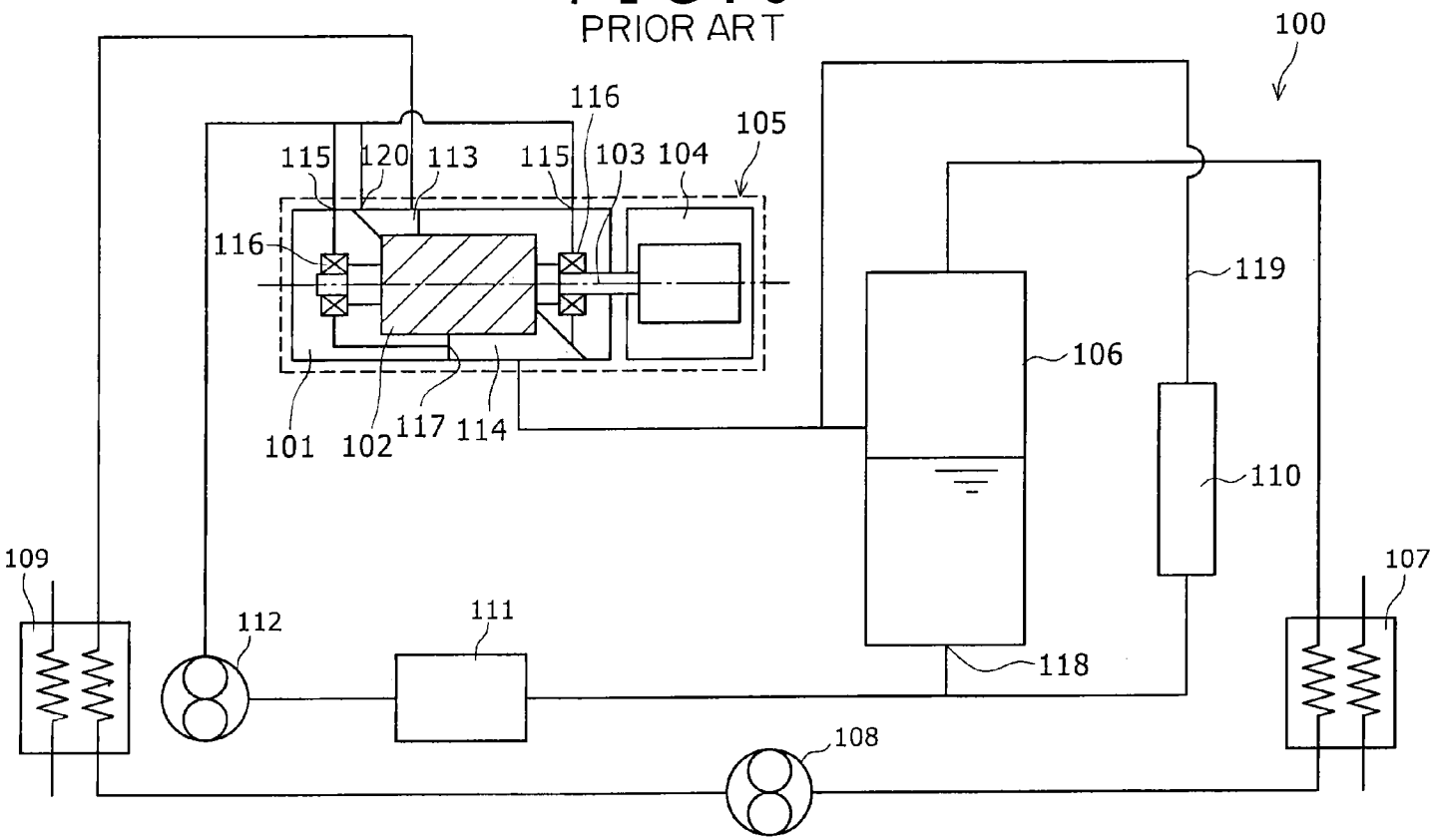
FIG. 6 PRIOR ART
FIG. 6 A schematic view of a conventional screw expander system.

FIG. 5 shows the screw expander system 10 of a fifth embodiment of the present invention. In the present embodiment, the same constituent elements as the first embodiment will be given the same reference numerals and description thereof will be omitted.

A returning flow passage 42 having one end connected so as to be branched from the main body outlet side line 27, and the other end connected so as to be merged with a pump outlet side line 40 serving as a flow passage connecting to an outlet of the pump 14 and the evaporator 15 is provided. An open/close valve 41 is disposed in the returning flow passage 42.

In a case where a flow meter (not shown) provided in the pump outlet side line 40 determines that a supply amount of the operating medium is excessive, the open/close valve 41 of the returning flow passage 42 is opened. Thereby, the mixture of the pump outlet side line 40 pressure-fed by the pump 14 is returned to the main body outlet side line 27. In such a way, in a case where the supply amount of the operating medium supplied from the pump outlet side line 40 is excessive, the supply amount can be corrected.

In the above embodiments, the screw expander system 10 in which a driving target of the screw expander 11 is the generator 12 is described as an example. However, the present invention is not limited to this, but the driving target may be a device other than the generator 12.

EXPLANATION OF REFERENCE NUMERALS

10: Screw expander system
11: Screw expander
12: Generator
13: Condenser
14: Pump
15: Evaporator
16: Oil separating tank
17: Screw rotor
18: Casing
19: Rotor shaft
20: Bearing
21: Operating medium inlet
22: Operating medium outlet
23: First oil inlet
24: Second oil inlet
25: First oil outlet
26: Second oil outlet
27: Main body outlet side line
28: Operating medium containing section
29: Oil containing section
30: Operating medium supply flow passage
31: Throttle mechanism (pressure adjusting means)
32: Bearing oil supply flow passage
33: Expander main body oil supply flow passage
34: Heat exchanger
35: Branch section
36: Preheater
37: Gas-liquid separator
38: Gas containing section
39: Liquid containing section
40: Pump outlet side line
41: Open/close valve
42: Returning flow passage
G: Generation unit

The invention claimed is:

1. A screw expander system, comprising:

a screw expander, including an expansion space formed by screw rotors meshed with each other, the expansion space being configured for expanding an operating medium, an operating medium inlet and an operating medium outlet communicating with the expansion space, a bearing for supporting a rotor shaft of the screw rotor, an oil inlet for supplying oil to the expansion space and the bearing, wherein the oil inlet includes a first oil inlet communicating with the bearing and a second oil inlet provided at the operating medium inlet and communicating with the expansion space, and an oil outlet for discharging the oil from at least one of the expansion space and the bearing;

a main body outlet side line connected to the operating medium outlet and the oil outlet, the main body outlet side line being configured for feeding the operating medium from the operating medium outlet and the oil from the oil outlet;

a condenser communicating with said main body outlet side line for condensing a gas in a mixture of the operating medium and the oil discharged by the screw expander and fed by said main body outlet side line;

a pump communicating with said condenser for receiving a liquid comprising the mixture of the operating medium and the oil from the condenser, the pump being configured to pressure-feed the liquid comprising the mixture of the operating medium and the oil from the condenser;

an evaporator configured for evaporating the operating medium in the mixture pressure-fed by said pump;

an oil separating tank provided between said evaporator and said screw expander for supplying the operating medium from said evaporator through an operating medium line to the operating medium inlet of said screw expander, and for supplying the oil from said evaporator to the first and second oil inlets of said screw expander, the oil separating tank having an operating medium containing section for containing the separated operating medium, and an oil containing section for containing the separated oil, and the oil containing section of said oil separating tank being connected via a separated oil supply line to the first and second oil inlets of said screw expander respectively, wherein said operating medium line extends from said oil separating tank to the operating medium inlet of said screw expander and does not receive the separated oil from said separated oil supply tank; and pressure adjusting means provided in the operating medium line between the operating medium containing section of said oil separating tank and the operating medium inlet of said screw expander for invariably causing a pressure downstream of the pressure adjusting means to be lower than a pressure upstream of the pressure adjusting means.

2. The screw expander system according to claim 1, further comprising:

a heat exchanger for exchanging heat between the mixture fed from said condenser to the side of said evaporator, and the oil supplied from said oil separating tank to the bearing through the first oil inlet.

3. The screw expander system according to claim 1, further comprising:

a branch section provided between said pump and said evaporator, wherein said branch section is connected to the second oil inlet communicating with the expansion space of the screw rotors.

4. The screw expander system according to claim 1, further comprising:

a preheater provided on the upstream side of said evaporator, the preheater for heating the mixture pressure-fed by said pump; and a gas-liquid separator for separating a mixture containing a gas and a liquid from a production well into a gas and a liquid, the gas-liquid separator having a gas containing section for containing the gas, and a liquid containing section positioned on the lower side of the gas containing section, for containing the liquid, wherein the gas is sent from the gas containing section of said gas-liquid separator to said evaporator, the mixture is evaporated by exchanging heat with the gas by said evaporator, the gas, the liquid, or the gas-liquid mixture from said evaporator, and the liquid from the liquid containing section of said gas-liquid separator are merged and fed to said preheater, heat is exchanged between the liquid or the gas-liquid mixture merged in said preheater, and the mixture pressure-fed by said pump, and then the gas-liquid mixture is fed out from said preheater to a reduction well.

5. The screw expander system according to claim 1, further comprising:

a returning flow passage connected in parallel across said pump, and an open/close valve disposed in said returning flow passage.

6. The screw expander system according to claim 1, wherein said pressure adjusting means is a throttle mechanism.

* * * * *